US005390457A

United States Patent [19]

Sjölander

[11] Patent Number: 5,390,457

[45] Date of Patent: Feb. 21, 1995

[54] MOUNTING MEMBER FOR FACE TILES

[76] Inventor: Oliver Sjölander, Hjortstigen 24, S-731 42 Köping, Sweden

[21] Appl. No.: 50,193

[22] PCT Filed: Nov. 8, 1991

[86] PCT No.: PCT/SE91/0754

§ 371 Date: May 5, 1993

§ 102(e) Date: May 5, 1993

[87] PCT Pub. No.: WO92/08857

PCT Pub. Date: May 29, 1992

[30] Foreign Application Priority Data

Nov. 9, 1990 [SE] Sweden ..... 9003572

[51] Int. Cl.[6] ..... E04F 13/08

[52] U.S. Cl. ..... 52/387; 52/482; 52/510; 52/715; 52/735

[58] Field of Search ..... 52/235, 508, 510, 513, 52/551, 387, 712, 478, 482, 506.01, 506.03, 385, 778, 779, 715, 735

[56] References Cited

U.S. PATENT DOCUMENTS

| | | | |
|---|---|---|---|
| 2,003,996 | 6/1935 | Finzer et al. | 52/482 |
| 2,005,030 | 6/1935 | Geisinger . | |
| 2,044,216 | 6/1926 | Klages . | |
| 2,150,459 | 3/1939 | Reintjes | 52/778 X |
| 2,862,585 | 12/1958 | McChesney | 52/508 |
| 3,022,869 | 2/1962 | Radek | 52/508 X |
| 3,230,682 | 1/1966 | Heuer | 52/513 X |
| 3,347,009 | 10/1967 | Meddick | 52/551 X |
| 4,635,424 | 1/1987 | Drapeau | 52/510 X |
| 4,753,053 | 6/1988 | Heard | 52/712 |
| 4,890,433 | 2/1990 | Funaki | 52/510 X |
| 4,924,642 | 5/1990 | Juell | 52/712 X |
| 5,029,425 | 7/1991 | Bogataj . | |

FOREIGN PATENT DOCUMENTS

| | | | |
|---|---|---|---|
| 2013857 | 8/1978 | Germany | 52/510 |
| 324446 | 6/1970 | Sweden . | |
| 421718 | 1/1982 | Sweden . | |
| 447000 | 10/1986 | Sweden . | |
| 2155970 | 10/1985 | United Kingdom . | |

*Primary Examiner*—Lanna Mai

*Attorney, Agent, or Firm*—William R. Hinds

[57] ABSTRACT

A mounting member for mounting face tiles on a building wall comprises an elongate profile member (11) adapted to be secured in vertical position on the building wall and having longitudinally spaced support hooks (17), each adapted to support a face tile. A resiliently displaceable retaining lip (10) is provided beneath such support hook (17). When in relieved condition, the retaining lip (19, 119, 219) projects forwardly from a tile backing plane (16) defined by the profile member so as to overlie a face tile supported by the next underlying support hook (17) and thereby prevent upward displacement of the face tile.

4 Claims, 2 Drawing Sheets

MOUNTING MEMBER FOR FACE TILES

This invention relates to a mounting member for face tiles, namely face tiles of the kind which have on a front side thereof a rebate along the upper tile edge and a downwardly directed tongue along the lower tile edge and have on the back side thereof a downwardly directed support rib positioned behind the tongue, and which are adapted to be positioned one above the other on a building wall with vertically adjoining tiles overlapping at their upper and lower edges such that the tongue of each overlying tile is received in the rebate of the next underlying tile.

An example of face tiles of the above-mentioned kind are the cement-based face tiles which are marketed under the trade mark Coloroc. These tiles are 300 or 600 mm long and 100 mm wide (high) and have a thickness of 30 mm.

SE-B-324 446 discloses a known mounting member for face tiles of the above-mentioned kind which comprises an elongate carrier element in the form of a U-shaped or channel member the flanges of which are provided along their free or outer edges with uniformly spaced support hooks for the face tiles. The carrier element is adapted to be secured in vertical position to the building wall with the support hooks extending outwardly or away from the building wall.

Mounting of the face tiles is commenced at the lower end of the carrier element. The tiles are inserted one after the other between adjacent support hooks and allowed to slide down so that their support rib is received in the lower support hook and their tongue is received in the rebate of the next underlying face tile. The support hooks and the support rib of the tiles are shaped and arranged such that the back side of the tiles engages the free edges of the flanges under the influence of gravity. Thus, these edges define a backing plane for the tiles.

Between the upper edge of a mounted face tile and the next upper support hook there is a certain free space so that the face tile can be displaced upwardly along the backing plane and moved forwardly over the lower support hook, i.e. the support hook on which the tile rested before the upward displacement. The face tiles can thus be dismounted relatively easily. This is sometimes advantageous, namely when it is actually desired to dismount the face tiles, such as when damaged tiles have to be replaced. However, the ease with which the face tiles can be dismounted also means that it may be tempting for children or others to dismount the tiles mischievously or for other reasons.

An object of the present invention is to provide a mounting member which lends itself to easy mounting of the face plates but retains them in such a manner that they cannot be dismounted very easily.

The mounting member of the invention is of the kind indicated above, that is, a mounting member comprising an elaongate carrier element provided with support hooks on which the face plates are mounted in the manner indicated above. For achieving the above-mentioned object in such a mounting member, the carrier element is provided beneath the said overlying support hook with a retaining lip which has an abutment edge facing the underlying support hook and is resiliently movable towards and away from the tile backing plane, the retaining lip in relieved condition thereof projecting forwardly from the tile backing plane so as to have its abutment edge positioned above, and closely spaced from, the top edge of a face tile carried by the said underlying support hook.

In the mounting member according to the invention, the retaining lip prevents the face tile from being lifted sufficiently to permit moving of the lower tile portion forwardly over the lower support hook and thereby to permit removal of the tile from the mounting member. The mounting of the face tile, on the other hand, can take place as easily as with the known mounting member, as the retaining lip is readily accessible and can be pushed inwardly by engagement with the upper tile portion or by finger pressure, whereas when the tiles are mounted the retaining lip is concealed behind the overlying face tile and is therefore inaccessible.

The invention is described in greater detail hereinafter with reference to the accompanying drawings.

Figure 1:
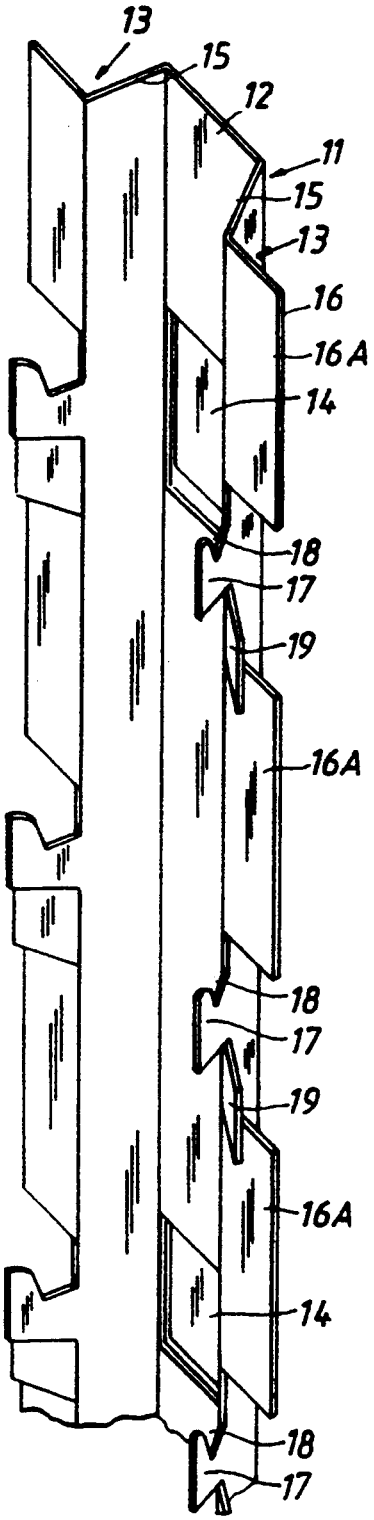
FIG. 1 is a perspective view of a portion of a support member embodying the invention.
Figure 2:
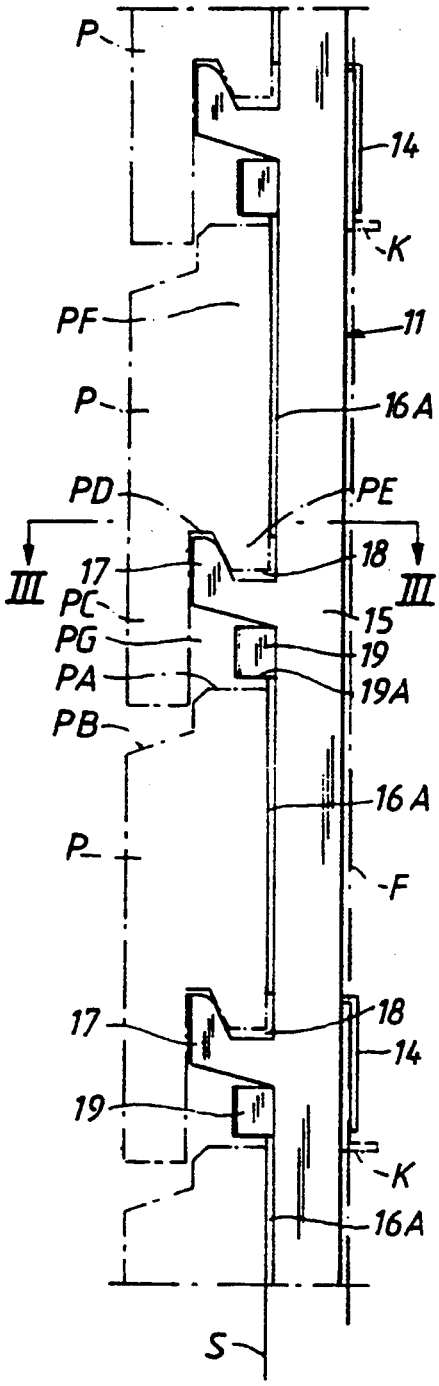
FIG. 2 is a side view of the mounting member of FIG. 1, a pair of support brackets for the mounting member and also a number of face tiles mounted on the mounting member being shown in phantom lines.
Figure 3:
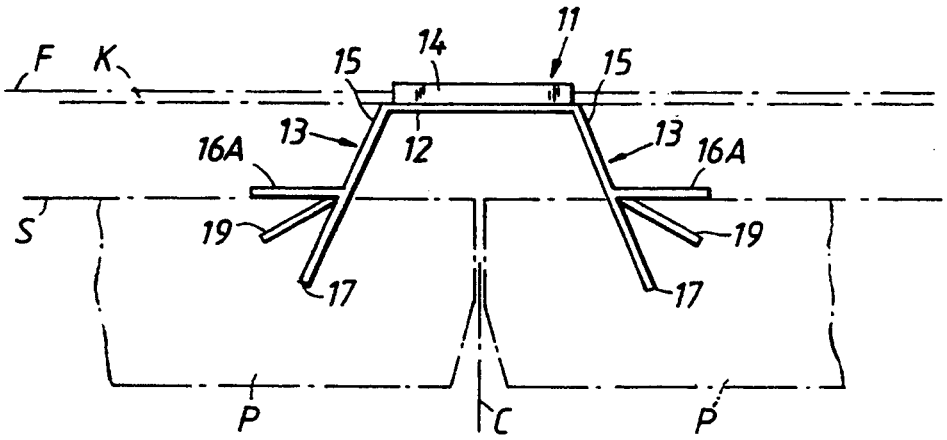
FIG. 3 is a cross-sectional view on line III—III of FIG. 2.

As shown by way of example in FIGS. 1–3, the moumting member according to the invention comprises an elongate carrier element in the form of a profile or channel member 11 of sheet metal which is adapted to be secured in vertical position to a building wall, indicated by a phantom line at F in FIGS. 2 and 3, which is to be clad with face tiles of the kind indicated above; in FIGS. 2 and 3 a number of such tiles are shown in phantom lines and designated by P.

The channel member 11 has a flat web 12 of uniform width and a pair of flanges 13 which extend from the longitudinal edges of the web. It is symmetrical about a plane C (FIG. 3) which is perpendicular to the web 12 and contains the longitudinal centre line of the web. The side of the web 12 which faces away from the flanges 13 is referred to herein as the back side and in use of the channel member engages or is positioned closely adjacent the building wall F. The opposite side of the web is referred to as the front side, and the flanges 13 accordingly can be regarded as extending forwardly from the web 12.

Tongues 14 are stamped out of the web 12 at regular intervals along the length of the web and offset rearwardly from the back side of the web such that they are parallel with the back side. These tongues serve as means for fastening the channel member 11 to the building wall F. To fasten the channel member 11, the tongues 14 are hooked onto parallel support bars which are secured to the building wall and spaced apart vertically by a distance corresponding to the distance between adjacent tongues. A pair of support bars of this kind are indicated in phantom lines at K in FIGS. 2 and 3.

Each flange 13 of the channel member 11 comprises a flat inner flange portion 15 including an obtuse angle of 110°–115° with the front side of the web 12, and a discontinuous or segmented outer flange portion 16 which extends from the front edge of the inner flange portion 15 and is in the form of flange segments 16A. The flange segments 16A, which are spaced apart along the length of the channel member, are substantially parallell with the web 12 of the channel member and extend laterally outwardly from the inner flange portion 15.

Between every two adjacent segments 16A of the outer flange portion 16 a support hook 17 projects forwardly from the inner flange portion 15 in the plane defined by the latter. The front edge of the support hook is parallel to the plane of the web 12, and the opening or mouth 18 of the hook is open and widens upwardly when wiewed with the channel member 11 in the properly fastened position on the building wall F.

Between each support hook 17 and the adjacent underlying segment 16A of the outer flange portion 16, there is a retaining lip 19, which projects from the front edge of the inner flange portion 15. In the relieved condition thereof, this retaining lip is positioned in a plane which is situated between the plane containing the support hooks 17 and the inner flange portion 15 and the plane containing the segments 16A of the outer flange portion 16, that is, the tile backing plane S. The retaining lip 19 is resiliently movable from the abovementioned position, which is best shown in FIGS. 1 and 3, towards the tile backing plane S.

The channel member 11 is made by plastic working and cutting of sheet material, preferably steel sheet. In the embodiment of the channel member which is illustrated in the drawings, portions of the sheet material are cut away, namely between each support hook 17 and the next overlying flange segment 16A. Such cutting away of sheet material portions is not absolutely neccessary, however, because if desired, the flange segment can be extended downwardly by the portion which is cut away in the illustrated embodiment.

FIG. 2 shows the cross-sectional shape of the facing tiles P which are to be mounted by means of the mounting member according to the invention; in this figure a few face tiles P positioned one above the other on the channel member 11 of FIG. 1 are shown in phantom lines. Face tiles of this kind are well known, see, for exmple, SE-B-313 904 and SE-B-324 446.

As shown in FIG. 2, each face tile P is provided on the front face or side thereof with a rebate PB along the upper edge of the tile. The depth of the rebate PB, as measured in the direction of the thickness of the tile, is slightly less than one-half of the thickness of the tile. Moreover, on the front side thereof, each tile P also has a downwardly directed tongue PC extending along the lower edge of the tile, the thickness of the tongue being substantially equal to the depth of the rebate PB.

Behind the tongue PC, and separated therefrom in the direction of the thickness of the tile by a groove PD extending along the root of the tongue, a support rib PE of downwardly tapering cross-section extends along the lower edge of the tile.

In the mounted position the face tiles P are disposed as shown in FIG. 2 with the support rib PE received in the mouth 18 of the support hook 17. As a consequence of the cross-sectional shape of the tiles and the shape of the support hooks 17, the tiles are firmly supported by the support hooks such that they are unable to move in the forward-backward direction. The back side of the tiles P engage, or are positioned close to, the front face of the outer flange portions 16, the flange segments 16A of which define the backing plane S for the tiles.

In contrast to the tiles supported by the mounting member known from SE-B-324 446, the face tiles supported by the mounting member according to the present invention are supported on their back side over a surface, namely the front face of the flange segments 16A, rather than just along an edge or edges of the channel member.

As is also shown in FIG. 2, the tongue PC of each face tile P extends downwardly into the rebate PB along the upper edge of the next underlying face tile P.

From FIG. 2 it is also seen that the distance, as measured along the length of the channel member 11, between adjacent support hooks 17 is slightly greater than the height of the inner or rear portion PF of the tile P resting on the lower support hook. When the face tile P is mounted on the channel member 11, as shown in FIG. 2, it is prevented from moving upwardly along the channel member by the retaining lip 19 which is positioned beneath the upper support hook 17 and which is rigid vertically and extends forwardly from the tile backing plane S. Consequently, the face tile is trapped in the space PG separating the adjacent support hooks 17 and accordingly cannot be removed from the channel member in as simple a manner as is possible with the known mounting member.

When the face tiles P are to be mounted, each tile is inserted with its inner portion PF in the space PG above the lower support hook 17. The retaining lip 19 adjacent the upper support hook can easily be depressed by pushing the tile inwardly so that the tile can slide down and its support rib PE can enter the lower support hook. The retaining lip 19 then springs back forwardly to its blocking or retaining position with its lower edge 19A defining an abutment which is closely spaced above the upper edge PA of the face tile.

Naturally, the design of the mounting member according to the invention not only makes more difficult the removal of the face plates which it is actually desired to prevent—namely the removal which is done mischievously and takes place at such areas of the building wall which can easily be reached from the ground—but also the removal which may occasionally be desirable, such as when damaged tiles have to be replaced. However, when it is desired to replace damaged tiles, the uppermost one of the tiles to be replaced can be broken intentionally so that the retaining lips securing the next underlying tile become accessible and can be depressed using the fingers or a simple tool.

If it is important to avoid breaking a tile to be able to remove an underlying tile, it is also possible to provide a special tool which can be used to depress the retaining lips without first removing the overlying tile.

Figure 4:
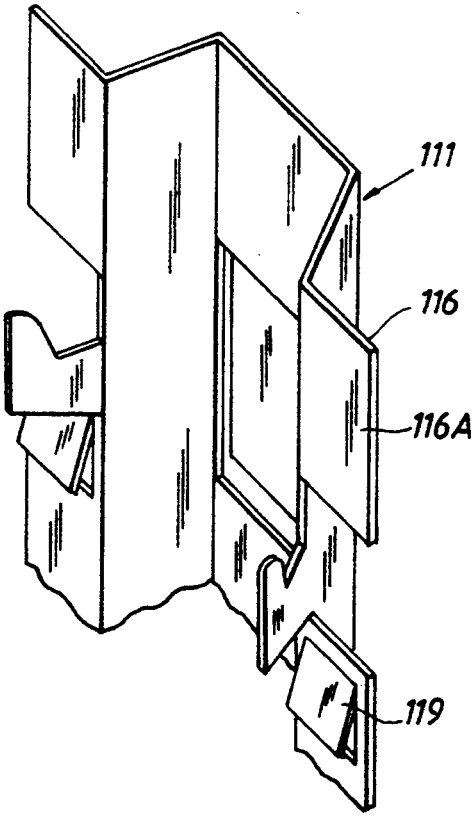
FIGS. 4 and 5 are perspective views similar to FIG. 1 and show a pair of modifications of the mounting member.
Figure 5:
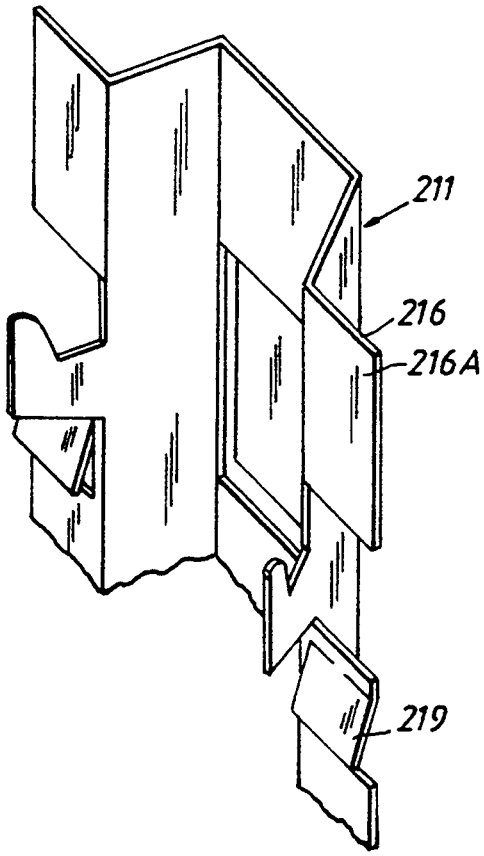

The modifications of the channel member shown in FIGS. 4 and 5, in which the channel member is designated by 111 and 211, respectively, differ from the embodiment shown in FIG. 1 only in that each segment 116A, 216A of the outer flange portion 116, 216 extends all the way up to the lower edge of the next overlying support hook 17 and incorporates the retaining lip 119, 219. In FIG. 4 the retaining lip 119 is punched out of the flange segment 116A along three cutting lines, namely at the lower end and at the sides of the lip. The modification shown in FIG. 5 can be regarded as differing from the modification of FIG. 4 only in that the horizontal cutting line at the lower end of the lip extends all the way to the outer edge of the flange segment 216A so that the outer vertical or lateral cutting line is eliminated.

Naturally, the illustrated and described tongues 14 for suspending the mounting member on support bars or similar supports may also be used in mounting members of previously known kinds, such as the mounting member disclosed in SE-B-324 446.

I claim:

1. A mounting member for face tiles (P) of the kind which have on a front side thereof a rebate (PB) along the upper tile edge (PA) and a downwardly directed tongue (PC) along the lower tile edge and have on the back side thereof a downwardly directed support rib (PE) positioned behind the tongue (PC), and which are adapted to be positioned one above the other on a building wall (F) with vertically adjoining tiles (P) overlapping at their upper and lower edges such that the tongue (PC) of each overlying tile is received in the rebate of the next underlying tile, the mounting member comprising an elongate carrier element (11) provided with support hooks (17) which are uniformly spaced along the length of the carrier element and project in the same direction from a tile backing plane (S) defined by the carrier element (11), the carrier element being adapted to be secured in vertical position on a building wall with the support hooks (17) extending away from the building wall, each support hook (17) being adapted to receive and carry the support rib (PE) of a tile (P) and to define together with the next upper support hook (17) a space (PG) for receiving a portion (PF) of a tile which is between the support rib (PE) and the top edge (PA) thereof with the top edge (PA) vertically spaced from the said next upper support hook (17), wherein the carrier element (11) is provided beneath the said next upper support hook (17) with a retaining lip (19,119,219) which has an abutment edge (19A) facing the next lower support hook (17) and is resiliently movable towards and away from the tile backing plane (S), the retaining lip in relieved condition thereof projecting forwardly from the tile backing plane (S) such that its abutment edge (19A) will be positioned above, and closely spaced from, the top edge (PA) of a face tile (P) carried by the said next lower support hook (17), wherein the carrier element (11) comprises a substantially flat web (12) and a flange (13) which extends along the length of the web and is disposed at an angle to the web and which comprises an inner flange portion (15) joined with the web and provided with the support hooks (17) adjacent to or in the tile backing plane (S), and wherein the flange (13) further comprises a segmented outer flange portion (16) disposed substantially in the tile backing plane (S) and the retaining lip (19,119,219) is selected from the group consisting of retaining lips provided above, on top of, or within, a segment (16A) of the outer flange portion (16).

2. A mounting member according to claim 1, characterised in that the segments (16A) of the the outer flange portion (16), the retaining lips (19,119,219) and the support hooks (17) are cut out of a continuous strip of material which is integrally joined with the inner flange portion (15) and, through the inner flange portion, with the web (12).

3. A mounting member according to claim 1, characterised in that the web (12) of the carrier element (11) is provided on the side thereof facing away from the flange or flanges (13) with support tongues (14) for suspending the carrier element on a building wall, the support tongues being uniformly spaced along the length of the carrier member (11) and formed by punching tongues from the web and offsetting them from the plane of the web.

4. A mounting member for face tiles (P) of the kind which have on a front side thereof a rebate (PB) along the upper tile edge (PA) and a downwardly directed tongue (PC) along the lower tile edge and have on the back side thereof a downwardly directed support rib (PE) positioned behind the tongue (PC), and which are adapted to be positioned one above the other on a building wall (F) with vertically adjoining tiles (P) overlapping at their upper and lower edges such that the tongue each overlying tile is received in the rebate of the next underlying tile, the mounting member comprising an elongate carrier element (11) provided with support hooks (17) which are uniformly spaced along the length of the carrier element and project in the same direction from a tile backing plane (S) defined by the carrier element (11), the carrier element being adapted to be secured in vertical position on a building wall with the support hooks (17) extending away from the building wall, each support hook (17) being adapted to receive and carry the support rib (PE) of a tile (P) and to define together with the next upper support hook (17) a space (PG) for receiving a portion (PF) of a tile which is between the support rib (PE) and the top edge (PA) thereof with the top edge (PA) vertically spaced from the said next upper support hook (17), wherein the carrier element (11) is provided beneath the said next upper support hook (17) with a retaining lip (19,119,219) which has an abutment edge (19A) facing the next lower support hook (17) and is resiliently movable towards and away from the tile backing plane (S), the retaining lip in relieved condition thereof projecting forwardly from the tile backing plane (S) such that its abutment edge (19A) will be positioned above, and closely spaced from, the top edge (PA) of a face tile (P) carried by the said next lower support hook (17), wherein the carrier element (11) is a channel member having a substantially flat web (12) and a pair of side flanges (13) along the opposed longitudinal web edges, each flange comprising an inner flange portion (15) which is joined with the web and provided with the support hooks (17) at or near the tile backing plane (S), and wherein each flange (13) comprises a segmented outer flange portion (16) disposed substantially in the tile backing plane (S) and the retaining lip (19,119,210) is selected from the group consisting of retaining lips provided above, on top of, or within, a segment (16A) of the outer flange portion (16).

* * * * *